US007863884B1

(12) United States Patent
Carper

(10) Patent No.: US 7,863,884 B1
(45) Date of Patent: Jan. 4, 2011

(54) SUB-VOLT BANDGAP VOLTAGE REFERENCE WITH BUFFERED CTAT BIAS

(75) Inventor: Scott Douglas Carper, San Jose, CA (US)

(73) Assignee: Intersil Americas Inc., Milpitas, CA (US)

( * ) Notice: Subject to any disclaimer, the term of this patent is extended or adjusted under 35 U.S.C. 154(b) by 22 days.

(21) Appl. No.: 12/350,899

(22) Filed: Jan. 8, 2009

Related U.S. Application Data

(60) Provisional application No. 61/020,133, filed on Jan. 9, 2008.

(51) Int. Cl.
*G05F 3/16* (2006.01)
*G05F 3/20* (2006.01)

(52) U.S. Cl. ..... 323/313; 323/316

(58) Field of Classification Search ..... 323/312–316, 323/901

See application file for complete search history.

(56) References Cited

U.S. PATENT DOCUMENTS 5,867,054 A * 2/1999 Kotowski ..... 327/513
6,016,051 A * 1/2000 Can ..... 323/315
6,054,898 A * 4/2000 Okuma et al. ..... 330/266
6,380,723 B1 4/2002 Sauer
6,549,065 B2 * 4/2003 Opris ..... 327/539
6,703,815 B2 * 3/2004 Biagi ..... 323/280
6,726,361 B2 * 4/2004 Bisping et al. ..... 374/178
6,788,041 B2 * 9/2004 Gheorghe et al. ..... 323/313
7,253,598 B1 * 8/2007 Doyle et al. ..... 323/316

* cited by examiner

*Primary Examiner*—Adolf Berhane
*Assistant Examiner*—Emily Pham
(74) *Attorney, Agent, or Firm*—Fogg & Powers LLC

(57) ABSTRACT

Circuits, methods, and apparatus that provide voltage references having a temperature independent output voltage that is less then the bandgap of silicon. The temperature coefficient and absolute voltage can be independently adjusted. One example generates two voltages, the first of which is proportional-to-absolute temperature and the second of which is complementary-to-absolute temperature. These voltages are placed across a first resistor. The first resistor is further connected to a second resistor to form a resistor divider. The resistor divider provides a reduced voltage that is below that bandgap of silicon. The temperature coefficient of the reference voltage provided by the resistor divider can be set by adjusting the first resistor. The absolute voltage provided can be set by adjusting the second resistor.

20 Claims, 6 Drawing Sheets

SUB-VOLT BANDGAP VOLTAGE REFERENCE WITH BUFFERED CTAT BIAS

CROSS-REFERENCES TO RELATED APPLICATIONS

This application claims the benefit of U.S. provisional patent application No. 61/020,133, titled SUB-VOLT BANDGAP VOLTAGE REFERENCE WITH BUFFERED CTAT BIAS, by Carper, filed Jan. 9, 2008, which is hereby incorporated by reference.

BACKGROUND

Bandgap voltage references are one of the main building blocks used in electronic circuits. Bandgap voltage references may be used in a myriad of applications, including cell phones, MP3 players, personal digital assistants, cameras, video recorders, and others.

Simply stated, a bandgap voltage reference receives a power supply and generates an output voltage. The bandgap voltage reference may be designed to provide an output voltage that is stable over temperature, or it may be designed to provide an output voltage that varies over temperature, for example to compensate for a change caused by temperature in another circuit or circuit element.

The output of the reference voltage may be used for a number of purposes. For example, a reference voltage output that is stable over temperature, that is, has a low temperature coefficient, can be placed across an external resistor to generate a current that is stable over temperature. Also, a reference voltage output can be used along with a regulator circuit to provide a regulated power supply.

Conventional bandgap circuits provide output voltages on the order of the bandgap of silicon or higher, that is, they provide output voltages that are at or exceed approximately 1.26 volts, though this value depends on the specific processing technology used. However, many modern circuits require a voltage less than the bandgap of silicon. For example, many newer technologies provide devices that have excessive leakage when their drain voltages are higher than approximately 1 volt. Also, lower voltages are often used where it is particularly desirable to save power. Another drawback of conventional circuits is that their temperature characteristics cannot be adjusted without changing their output voltage.

Thus, what is needed are circuits, methods, and apparatus that provide bandgap voltage references having output voltages less than the bandgap of silicon. It is also desirable that the output voltage and temperature coefficient be independently adjustable.

SUMMARY

Accordingly, embodiments of the present invention provide circuits, methods, and apparatus that provide voltage references having a temperature independent output voltage that is less than the bandgap of silicon. The temperature coefficient and absolute voltage of the voltage reference output can be independently adjusted.

A specific embodiment of the present invention generates two voltage sources, one of which is proportional-to-absolute temperature (PTAT), the other of which is complementary-to-absolute temperature (CTAT). These voltages are placed across a first resistor. The first resistor is further connected to a second resistor to form a resistor divider. The resistor divider provides a reduced voltage that is below that bandgap of silicon.

In this specific embodiment of the present invention, the temperature coefficient of the reference voltage provided by the resistor divider can be set by adjusting the first resistor. The absolute voltage provided can be set by adjusting the second resistor.

Various embodiments of the present invention may incorporate one or more of these and the other features described herein. A better understanding of the nature and advantages of the present invention may be gained by reference to the following detailed description and the accompanying drawings.

DESCRIPTION OF EXEMPLARY EMBODIMENTS

Figure 1:
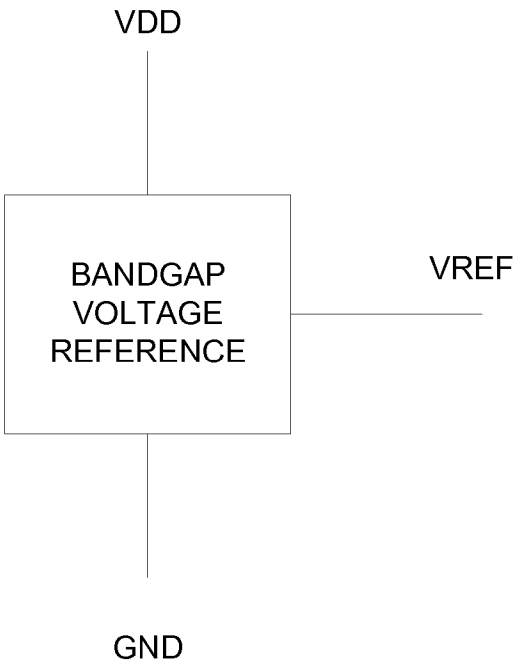
FIG. 1 is a symbolic representation of a bandgap voltage reference that is improved by the incorporation of embodiments of the present invention.

FIG. 1 is a symbolic representation of a bandgap voltage reference that is improved by the incorporation of embodiments of the present invention. The bandgap voltage reference receives a power supply and generates an output voltage Vref. The power supply may be a positive voltage, shown here as VDD, and ground. Alternately, ground and a negative voltage may be provided. In still other embodiments of the present invention, positive and negative voltages, or positive, negative voltages along with ground may be received. As a result, the output voltage provided may be above, or below, ground.

Figure 2:
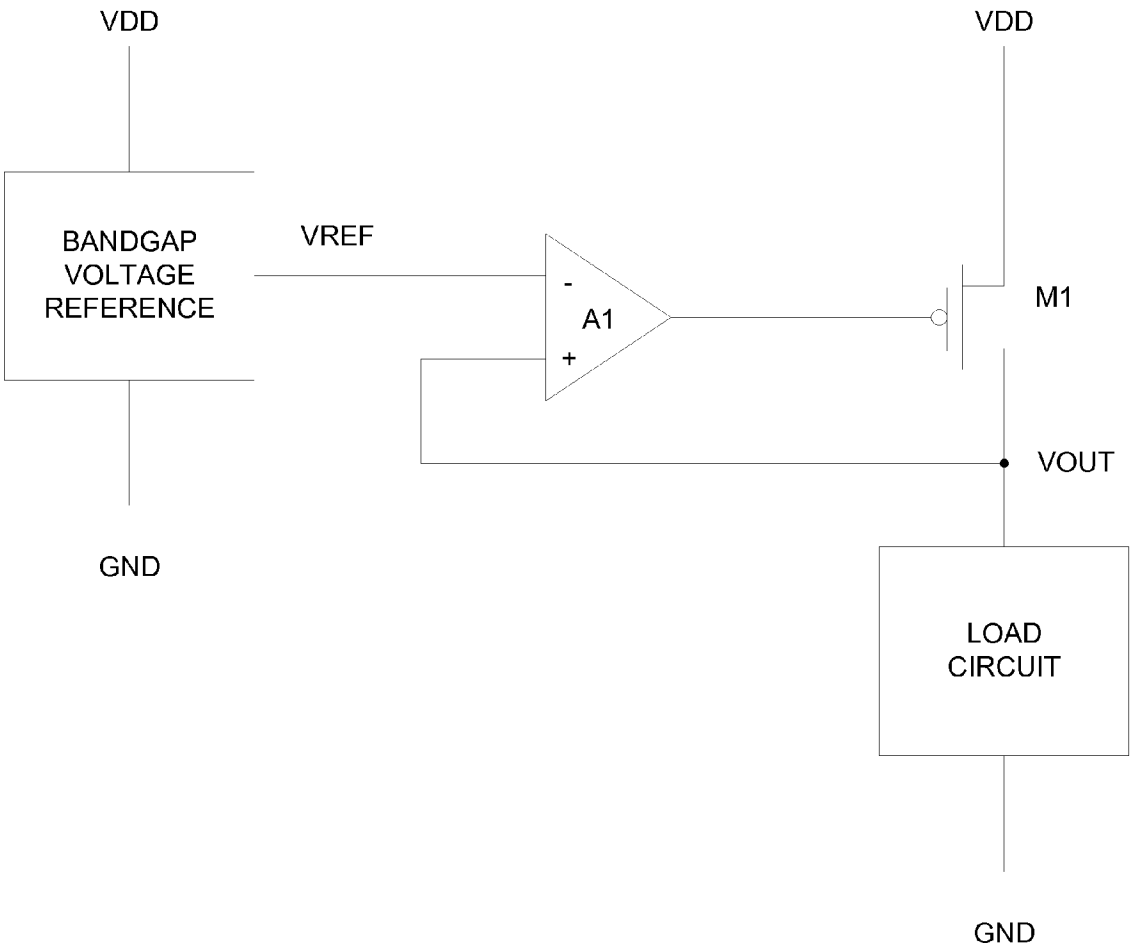
FIG. 2 is a block diagram of an electronic system that may be improved by the incorporation of an embodiment of the present invention.

FIG. 2 is a block diagram of an electronic system that may be improved by the incorporation of an embodiment of the present invention. This figure includes a bandgap voltage reference, amplifier A1, power transistor M1, and a load circuit.

The bandgap voltage reference provides an output Vref, which is received by an inverting input of the amplifier A1. The output of amplifier A1 drives power transistor M1. Power transistor M1 provides current to the load circuit. The resulting regulated power supply of Vout at the load circuit is fed back to amplifier A1, where it is compared to the reference voltage Vref. Differences between these two voltages drive the output of amplifier A1 such that these two voltages are equalized.

For example, if Vout is higher than desired, the output of amplifier A1 increases. This, in turn reduces the current provided by M1, thus lowering the regulated output voltage Vout. Similarly, if Vout is lower than desired, the output of amplifier A1 decreases, turning M1 on harder, thereby increasing its current. This results in an increase in the voltage Vout.

It is often desirable that the regulated voltage Vout be stable over temperature. That is, it is desirable that the regulated voltage Vout has a low temperature coefficient. In some circuits, it is also desirable that the regulated voltage Vout be less than the bandgap of silicon. Accordingly, embodiments of the present invention provide a bandgap voltage reference that provides a reference voltage output that is less than the bandgap of silicon and has a low temperature coefficient. In other embodiments of the present invention, the temperature coefficient may be set to compensate for temperature effects seen elsewhere. For example, it may be desirable that at high-temperature the load circuit receives a higher regulated voltage. Alternately, it may be desirable that at high temperatures the load circuit receives a lower regulated voltage. Accordingly, the bandgap voltage reference temperature coefficient provided by a bandgap voltage reference according to an embodiment of the present invention can be adjusted.

Figure 3:
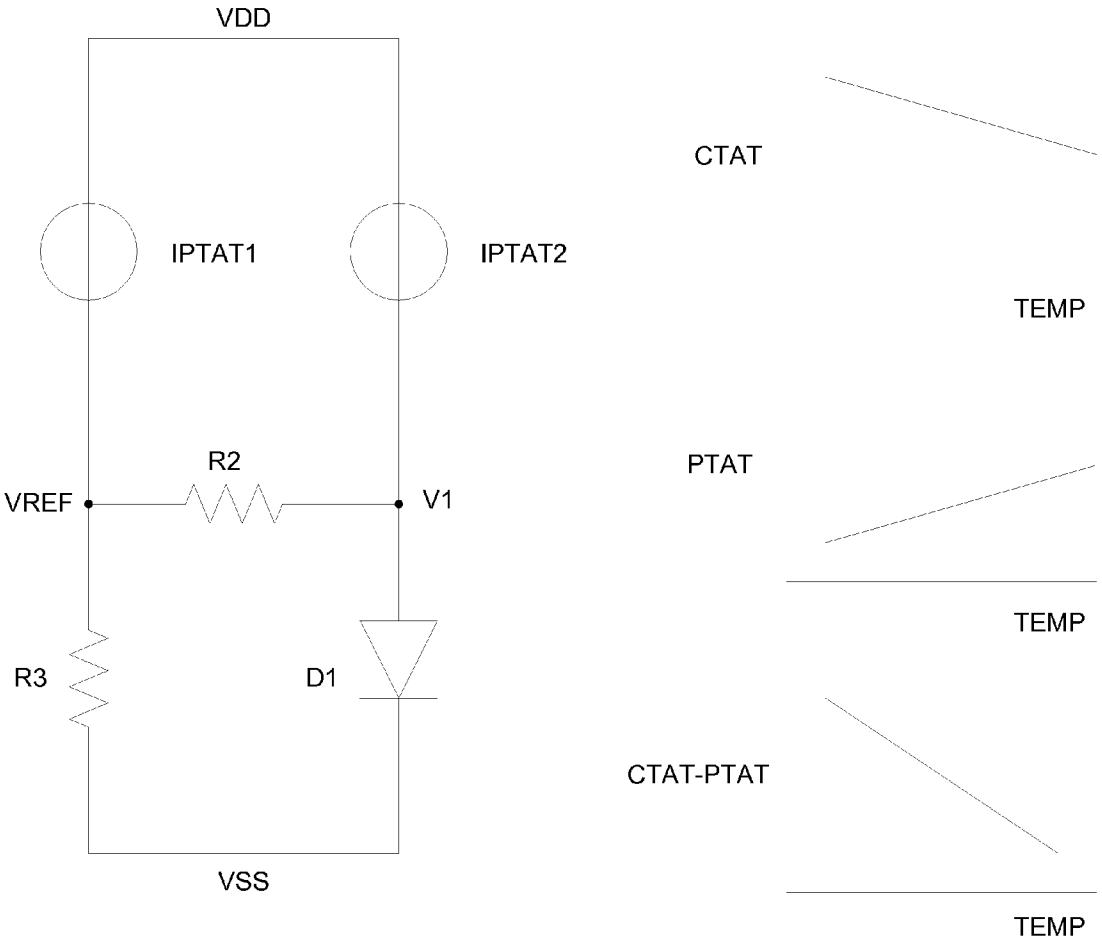
FIG. 3 is a simplified schematic of a bandgap voltage reference according to an embodiment of the present invention.

FIG. 3 is a simplified schematic of an embodiment of the present invention. This figure includes two current sources to provide currents that are proportional-to-absolute temperature. Also included are resistors R2 and R3, and diode D1.

Applying the principles of superposition and removing R2, the current sources generate a voltage Vref across R3 that is proportional-to-absolute temperature, and a voltage V1 across diode D1. The voltage V1 across diode D1 decreases as the temperature increases. Accordingly, the voltage V1 across diode D1 is complementary-to-absolute temperature.

With R2 included, a voltage that is the difference between a first voltage that is complementary-to-absolute temperature and a second voltage that is proportional-to-absolute temperature is placed across resistor R2. This in turn generates a current that strongly decreases as temperature increases. This is shown in the included graphs.

The proportional-to-absolute temperature current IPTAT1 is combined with the current in R2. The magnitude of the resistor R2, and thus the resulting current through R2, can be adjusted such that Vref has a low temperature coefficient. Moreover, the output voltage Vref can be adjusted by changing the value of R3. In a specific embodiment of the present invention, R3 is a series of resistors, the series of resistors having switches at a number of intermediate nodes, where the output Vref is coupled to an intermediate node between two of the series of the resistors by one of the switches.

Figure 4:
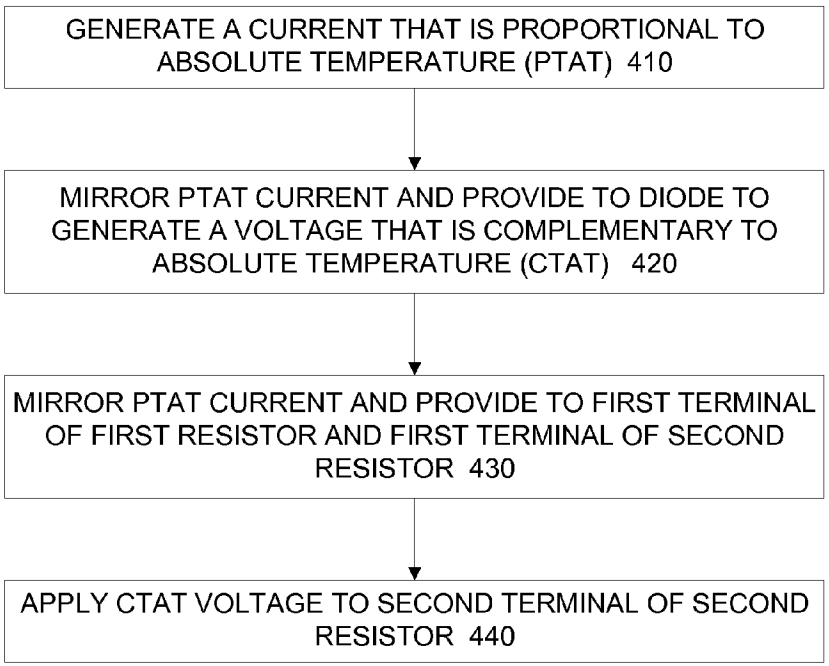
FIG. 4 is a flowchart of a method of generating a bandgap voltage reference according to an embodiment of the present invention.

FIG. 4 is a flowchart of a method of generating a bandgap voltage reference according to an embodiment of the present invention. Specifically, in act 410, a current that is proportional-to-absolute temperature is generated. This current is mirrored and provided to a diode to generate a voltage that is complementary-to-absolute temperature in act 420.

In act 430, the proportional-to-absolute temperature current is mirrored again and provided to a first terminal of a first resistor and a first terminal of a second resistor. In act 440, the complementary-to-absolute temperature voltage is applied to a second terminal of the second resistor. A bandgap reference voltage is then available at the first terminal of the first resistor. The second resistor may be scaled to provide the desired temperature coefficient for the output voltage, while the first resistor may be scaled to adjust the absolute voltage of the bandgap reference voltage.

Figure 5:
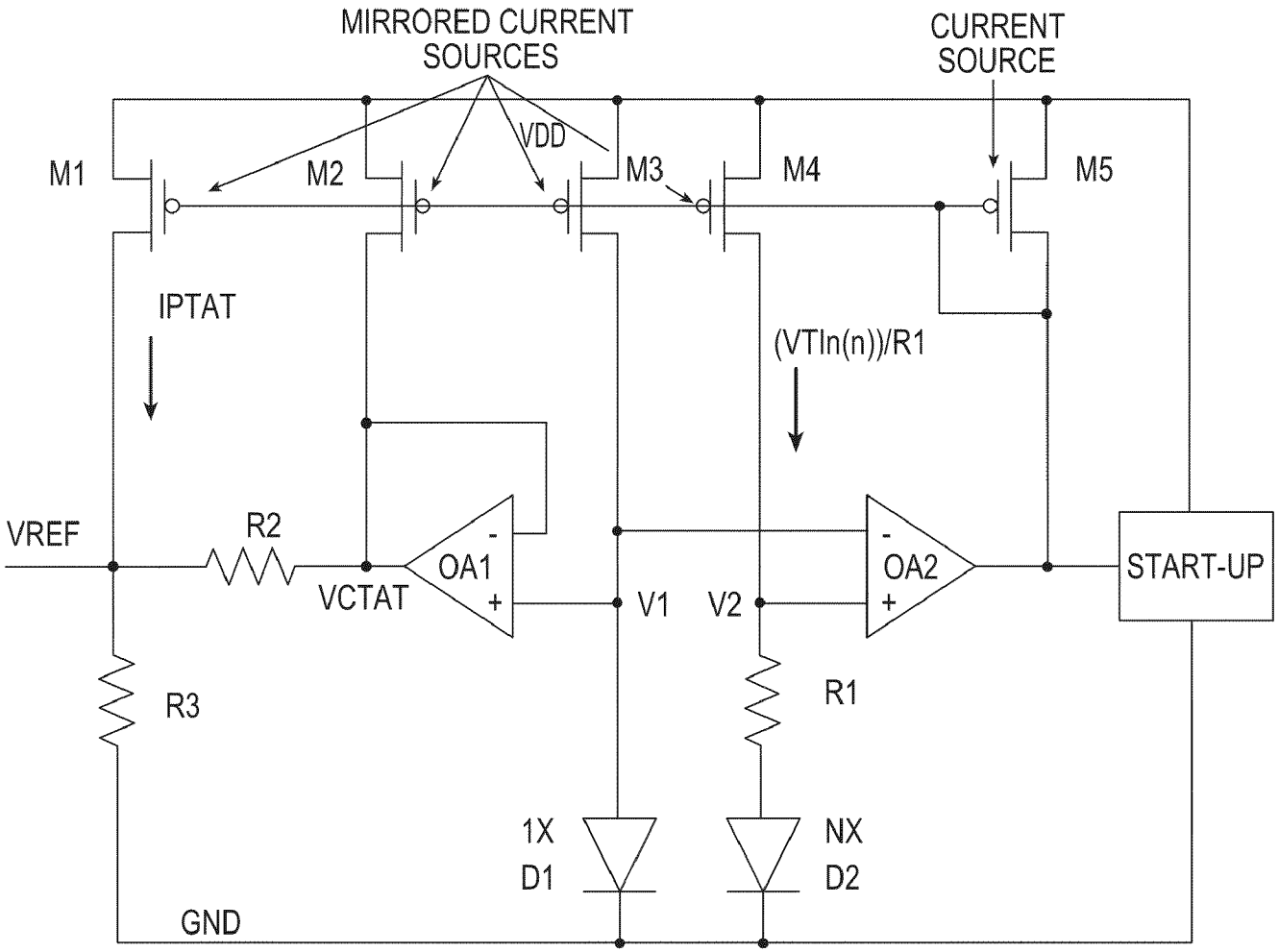
FIG. 5 is a schematic of a bandgap voltage reference according to an embodiment of the present invention.

FIG. 5 is a schematic of a bandgap voltage reference according to an embodiment of the present invention. This figure includes proportional-to-absolute temperature current generating circuit including diodes D1 and D2, resistor R1, and amplifier OA2.

Amplifier OA2 generates a current through transistor M5, which is mirrored through transistors M2, M3, and M4. Transistors M2, M3, M4, and M5 may each be the same size, or they may have different sizes. In this example, they are p-channel devices, though in other embodiments they may be bipolar PNP transistors, multiple p-channel devices, or other devices. The current mirrored by M2 provides current for the output stage of amplifier OA1, which may thus have an open drain output stage. The current mirrored by transistor M3 is provided to diode D1, resulting in a voltage V1. Similarly, current in transistor M4 is provided to resistor R1 and diode D2, resulting in a voltage V2. Amplifier OA2 compares voltages V1 and V2 and adjusts the current in M5, and thereby the currents in transistors M3 and M4, such that voltages V1 and V2 are equal.

Diode D2 is a multiple of diode D1. As shown here, diode D2 is "N" times the size of diode D1. Typically, this is achieved by replicating a diode the size of diode D1 N number of times. For example, diode D2 may be made up of eight diodes, each the size of diode D1. In a specific embodiment of the present invention, the diodes are implemented using substrate PNPs, though in other embodiments of the present invention they may be other P-N junctions. Resistors R1, R2, and R3 may be polysilicon or other type of resistor.

As before, the resulting voltage V1 is complementary-to-absolute temperature. The voltage V1 is buffered by amplifier OA1 and provided to the resistor R2. In this example, amplifier OA1 acts as a voltage follower to prevent R2 from bleeding current from the diode D1.

Again, ignoring resistor R2, the voltage across resistor R3 is proportional-to-absolute temperature. This means the voltage across R3 would have a large temperature coefficient temperature coefficient. Accordingly, R2 is inserted and connected to the complementary-to-absolute temperature voltage provided by amplifier OA1. As before, this voltage has a large negative temperature coefficient. By adjusting R2, these temperature coefficients are canceled, resulting in an output voltage Vref having a low temperature coefficient. Moreover, resistor R3 may be adjusted to provide a desirable output voltage Vref.

Care should be taken in the design of bandgap voltage reference circuits to ensure that they properly start up when their power supply is turned on. For example, in the present circuit, if the current in transistor M5 is zero, the voltages V1 and V2 will both be zero and thus be equal. Though undesirable, this is a stable state. Accordingly, this specific embodiment of the present invention employs a start-up circuit that provides an initial current in transistor M5 such that this undesirable state does not occur.

Figure 6:
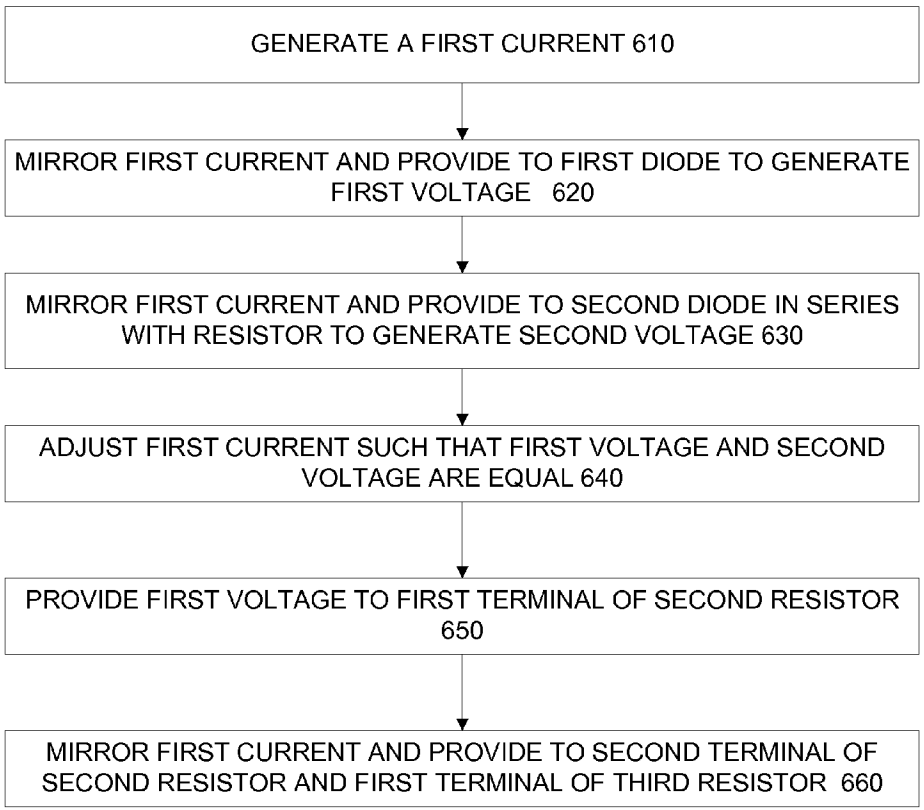
FIG. 6 is a flowchart illustrating another method of generating a bandgap voltage according to an embodiment of the present invention.

FIG. 6 is a flowchart illustrating another method of generating a bandgap voltage according to an embodiment of the present invention. In act 610, a first current is generated. In act 620, the first current is mirrored and provided to a first diode to generate a first voltage. The first current is mirrored and provided to a second diode that is in series with a resistor to generate a second voltage in act 630.

In act 640, the first current is adjusted such that the first voltage and the second voltages are equal. The first voltage is then provided to a first terminal of a second resistor in act 650. The first current is then mirrored and provided to a second terminal of the second resistor and a first terminal of the third resistor. The output voltage is then available at the first terminal of the third resistor.

The above description of exemplary embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated.

What is claimed is:

1. A bandgap voltage reference comprising:

a proportional-to-absolute temperature generator comprising a first diode;

a first current source to provide a proportional-to-absolute temperature current to an anode of the first diode;

a second current source to provide a proportional-to-absolute temperature current to a first terminal of a first resistor;

a first terminal of a second resistor coupled to the first terminal of the first resistor;

a voltage follower coupled between the anode of the first diode and a second terminal of the second resistor; and a third current source to provide a proportional-to-absolute temperature current to the second terminal of the second resistor.

2. The bandgap voltage reference of claim 1 wherein a second terminal of the first resistor is coupled to ground.

3. The bandgap voltage reference of claim 1 further comprising the voltage follower coupled between the anode of the first diode and the second terminal of the second resistor to provide a complementary-to-absolute temperature voltage to the second terminal of the second resistor.

4. The bandgap voltage reference of claim 1 wherein the first diode is formed using a substrate PNP.

5. The bandgap voltage reference of claim 1 wherein the bandgap voltage reference provides an output voltage less than the bandgap of silicon.

6. The bandgap voltage reference of claim 5 wherein the bandgap voltage reference provides the output voltage to a low-dropout regulator.

7. A bandgap voltage reference comprising:

a first diode;

a second diode in series with a first resistor;

a first current source to provide current to the first diode;

a second current source to provide current to the second diode and the first resistor an amplifier coupled to the first current source and the second current source to adjust currents in the first current source and the second current source such that a voltage across the first diode is equal to a voltage across the second diode and first resistor; and a third current source to provide current to a first node of a second resistor and a first node of a third resistor, wherein a second node of the second resistor is coupled to the first diode.

8. The bandgap voltage reference of claim 7 wherein the second diode is N times larger than the first diode.

9. The bandgap voltage reference of claim 7 further comprising a voltage follower coupled between the first diode and the second node of the second resistor.

10. The bandgap voltage reference of claim 7 further comprising a second amplifier coupled between the first diode and the second node of the second resistor.

11. The bandgap voltage reference of claim 7 wherein the first current source, second current source, and third current source are part of a current mirror.

12. The bandgap voltage reference of claim 7 wherein a second node of the third resistor is coupled to ground.

13. The bandgap voltage reference of claim 7 wherein the first and second diodes are formed using substrate PNPs.

14. The bandgap voltage reference of claim 7 wherein the bandgap voltage reference provides an output voltage less than the bandgap of silicon.

15. The bandgap voltage reference of claim 14 wherein the bandgap voltage reference provides the output voltage to a low-dropout regulator.

16. An electronic system, comprising:

a voltage reference including a diode, a first current source to provide a proportional-to-absolute temperature current to an anode of the diode, a second current source to provide a proportional-to-absolute temperature current to a first terminal of a first resistor, a first terminal of a second resistor coupled to the first terminal of the first resistor, a first amplifier coupled between the anode of the diode and a second terminal of the second resistor, and a third current source to provide a proportional-to-absolute temperature current to the second terminal of the second resistor;

a second amplifier, a first input of the second amplifier coupled to the first terminal of the first resistor;

a transistor, an input of the transistor coupled to an output of the second amplifier, and an output of the transistor coupled to a second input of the second amplifier; and a load coupled to the transistor to receive a regulated output voltage from the transistor.

17. The electronic system of claim 16, wherein the voltage reference comprises a bandgap voltage reference.

18. The electronic system of claim 16, wherein the voltage reference provides an output voltage less than the bandgap of silicon.

19. The electronic system of claim 16, wherein the second amplifier further comprises the second amplifier to compare a first voltage at the first input to a second voltage at the second input.

20. The electronic system of claim 16, wherein the second amplifier further comprises the second amplifier to equalize a first voltage at the first input to a second voltage at the second input.

* * * * *